US005485788A

United States Patent [19]

Corney

[11] Patent Number: 5,485,788

[45] Date of Patent: Jan. 23, 1996

[54] COMBINATION EXPLOSIVE PRIMER AND ELECTRO-EXPLOSIVE DEVICE

[75] Inventor: Martin Corney, Glendora, Calif.

[73] Assignee: Hughes Missile Systems Company, Los Angeles, Calif.

[21] Appl. No.: 313,625

[22] Filed: Sep. 27, 1994

[51] Int. Cl.[6] ..... F42B 5/08

[52] U.S. Cl. ..... 102/472; 102/202.1; 102/202.2; 102/210

[58] Field of Search ..... 102/202.1, 202.2, 102/430, 470, 472, 210; 42/84; 89/28.05, 28.1, 135

[56] References Cited

U.S. PATENT DOCUMENTS

| | | | |
|---|---|---|---|
| H210 | 2/1987 | Harris . | |
| 1,485,404 | 3/1924 | Martin et al. | 102/472 |
| 2,827,851 | 3/1958 | Ferrara . | |
| 2,853,012 | 9/1958 | Rotkin et al. . | |
| 2,970,545 | 2/1961 | Howe . | |
| 3,094,932 | 6/1993 | Greenlees . | |
| 3,198,074 | 8/1965 | Perkins . | |
| 3,208,181 | 9/1965 | Calhoun et al. . | |
| 3,349,709 | 10/1967 | Vilbajo . | |
| 3,363,566 | 1/1968 | Giattino et al. | 102/210 |
| 3,589,294 | 6/1971 | Stresau . | |
| 3,608,492 | 9/1971 | Mitchell . | |
| 3,859,746 | 1/1975 | Pecksen . | |
| 3,963,966 | 6/1976 | Mohr | 102/210 |
| 3,967,141 | 6/1976 | Gawlick et al. | 102/210 |
| 4,037,538 | 7/1977 | Andrews et al. | 102/210 |
| 4,777,881 | 10/1988 | Candland et al. | 102/472 |
| 5,040,463 | 8/1991 | Beaverson . | |
| 5,235,192 | 8/1993 | Corney | 102/472 |
| 5,303,495 | 4/1994 | Harthcock | 42/84 |

FOREIGN PATENT DOCUMENTS

| | | | |
|---|---|---|---|
| 2400688 | 4/1979 | France . | |
| 2043340 | 3/1972 | Germany | 102/210 |
| 2206646 | 8/1972 | Germany | 102/210 |
| WO92/00498 | 1/1992 | WIPO | 102/210 |

*Primary Examiner*—Harold J. Tudor
*Attorney, Agent, or Firm*—Charles D. Brown; Randall M. Heald; Wanda K. Denson-Low

[57] ABSTRACT

A system (10) for detonating an electro-explosive device (EED) (46) includes a primer (40, 70) connected to an expansion chamber (36) by a shaped vent passage (38). A releasably retained element (60) within the expansion chamber (36) is propelled by expanding gas from the detonated primer to impact a piezoelectric crystal (48) in circuit with the EED (46). Particular safety arrangements are disclosed which prevent the application of voltage from the crystal to the EED until the system is intentionally activated. Some of these arrangements also prevent electromagnetic interference and stray field voltages from reaching the EED.

26 Claims, 3 Drawing Sheets

COMBINATION EXPLOSIVE PRIMER AND ELECTRO-EXPLOSIVE DEVICE

BACKGROUND OF THE INVENTION

1. Field of the Invention

The present invention relates generally to electro-explosive devices and activating systems therefore and, more particularly, to systems in which an explosive primer, either percussive or electric, is used to initiate an electro-explosive device.

2. Description of the Related Art

An electro-explosive device (EED), such as a bridgewire, electric igniter, electric EED, electric detonator or the like, is commonly used as a detonator to initiate an ordnance device such as a rocket, bomb, mine or other explosive charge into which the electro-explosive device has been placed. An EED, for example, typically consists of a casing containing a heat-sensitive explosive material which may be ignited by a bridgewire when the bridgewire is electrically heated by application of electrical current to the terminal wires of the EED. The bridgewire and the heat-sensitive explosive material are commonly sealed within a casing in a waterproof manner with a packing material such as plastic, the terminal wires extending through the packing material out of the EED. In a typical ordnance or explosive application, the EED is embedded into a solid rocket propellant or explosive charge, with the terminal wires from the EED leading to a battery and triggering circuit. Examples of such arrangements are U.S. Pat. Nos. 3,094,932 of Greenlees and 3,608,492 of Mitchell.

Arrangements of this type are inconvenient and inherently unreliable because they require a battery as an external source of energy. It is not feasible to incorporate batteries in products such as shells, rockets or other packaged explosives because the shelf life of such items is indeterminate. Furthermore, the connecting conductors between the energy source and the EED may fail under the shocks encountered in normal handling of the product. A variant of a system using a remote power source to fire an electric igniter is described in the Netherlands patent 7201875 which incorporates a separate unit containing a piezoelectric crystal coupled over electrical leads to the electric igniter.

Piezoelectric devices exhibit the property of converting mechanical energy to electrical energy. Impacting a piezoelectric device develops an electrical pulse between opposite faces of the piezoelectric crystal. It is known to package a piezoelectric crystal in a cartridge in association with various types of projectiles or other explosives in order that the piezoelectric device may function as a detonator for the explosive. Typical arrangements of this type are disclosed in Rotkin et al U.S. Pat. No. 2,853,012, Perkins U.S. Pat. No. 3,198,074, Calhoun et al U.S. Pat. No. 3,208,181, Vilbajo U.S. Pat. No. 3,349,709, Stresau U.S. Pat. No. 3,589,294 and Pecksen U.S. Pat. No. 3,859,746. Also see French patent 2,400,688.

In order to minimize the external mechanical force needed to energize the piezoelectric crystal, it is known to incorporate an explosive primer with the piezoelectric element so that activation of the primer results in an explosion which is directed to the piezoelectric crystal, thereby multiplying the mechanical energy initiated by the firing pin to the mechanical pulse that impinges on the piezoelectric crystal. Such an energy converting device is the subject of U.S. Pat. No. 2,970,545 of Howe.

A similar arrangement is disclosed in United States Statutory Invention Registration No. H210 of Harris wherein the explosive primer is ignitable by a bridgewire. Harris requires the application of a high voltage signal simultaneously for safety purposes.

U.S. Pat. No. 5,040,463 of Beaverson discloses the use of a high pressure gas to actuate a firing mechanism by firing a detonator which shocks the piezoelectric element to develop the firing pulse for the associated main explosive.

U.S. Pat. No. 3,859,746 of Pecksen discloses a spring-biased impacting element which, upon release, drives a piezoelectric voltage generator to develop the electrical pulse needed to ignite the detonator of an associated propellant charge. A similar arrangement is disclosed in U.S. Pat. No. 2,827,851 of Ferrara. A plethora of similar references indicates that piezoelectric devices in association with an electrically energized detonator are well-known in the art and that some of these arrangements may incorporate a primary percussive element to develop the mechanical force required for activating the piezoelectric element.

SUMMARY OF THE INVENTION

Each of these known prior art arrangements, however, presents one drawback or another which precludes the arrangement from performing satisfactorily in applications to which the present invention is directed. Embodiments of the present invention incorporate structural configurations that permit the firearm or gun system which is designed for either percussive or electric primers to fire electro-explosive devices without changing the standard firing pin or electrical initiator system.

In one particular arrangement in accordance with the invention, a prior art firearm or gun system is fired through the application of an electrical impulse from a piezoelectric crystal. In this arrangement, the piezoelectric crystal is activated by impacting it with a mechanical striker. A conventional primer, either percussive or electrical, is used to drive a flyer plate against the piezoelectric crystal. The flyer plate acts to control and/or concentrate the mechanical shock against the piezoelectric crystal. In accordance with a further aspect of the invention, arrangements are incorporated to protect the electro-explosive device against accidental firing.

In one such arrangement, the piezoelectric crystal is installed on the forward face of the flyer plate rather than adjacent the electric detonator. The piezoelectric crystal is electrically isolated from the detonator until firing is to occur. In this arrangement the electrical pulse generated by the crystal is applied to a pair of contacts, also on the forward face of the flyer plate. A mating pair of contacts at the forward end of the expansion chamber is in alignment with the contacts on the flyer plate and electrically connected with the electric detonator. When the flyer plate with its piezoelectric crystal is driven forward to impact the piezoelectric crystal, the respective pairs of contacts close the electrical circuit between the piezoelectric crystal and the electric detonator, thereby applying the pulse from the piezoelectric crystal to the detonator at the instant that it is generated.

Another such arrangement also utilizes a piezoelectric crystal installed on the forward face of the flyer plate. This uses a similar contact arrangement in which mating electrical contacts adjacent the piezoelectric crystal and the electric detonator, respectively, serve to complete the firing circuit when the flyer plate is driven forward by the detonation of the primer. In this arrangement, however, the forward wall of the expansion chamber is shaped with a recess or pocket. The piezoelectric crystal is installed on the forward face of the flyer plate so that it enters the pocket upon forward motion of the flyer plate to develop the impact to the crystal. A safing shear wire is connected between the two contacts for the piezoelectric crystal on the face of the flyer plate. A similar safing shear wire is connected between the mating contacts at the forward end of the expansion chamber. Both of these shear wires are configured in position between the piezoelectric crystal and pocket so that they are severed just prior to the crystal impact. In this arrangement, the electrical contacts are maintained shorted until just prior to the impact of the piezoelectric crystal which causes it to generate the firing pulse for the electric detonator. In this way the electric detonator circuit is rendered safe against detonation from stray electrical fields until the last instant before firing.

BRIEF DESCRIPTION OF THE DRAWINGS

A better understanding of the present invention may be realized from a consideration of the following detailed description, taken in conjunction with the accompanying drawings in which.

DESCRIPTION OF THE PREFERRED EMBODIMENTS

Figure 1:
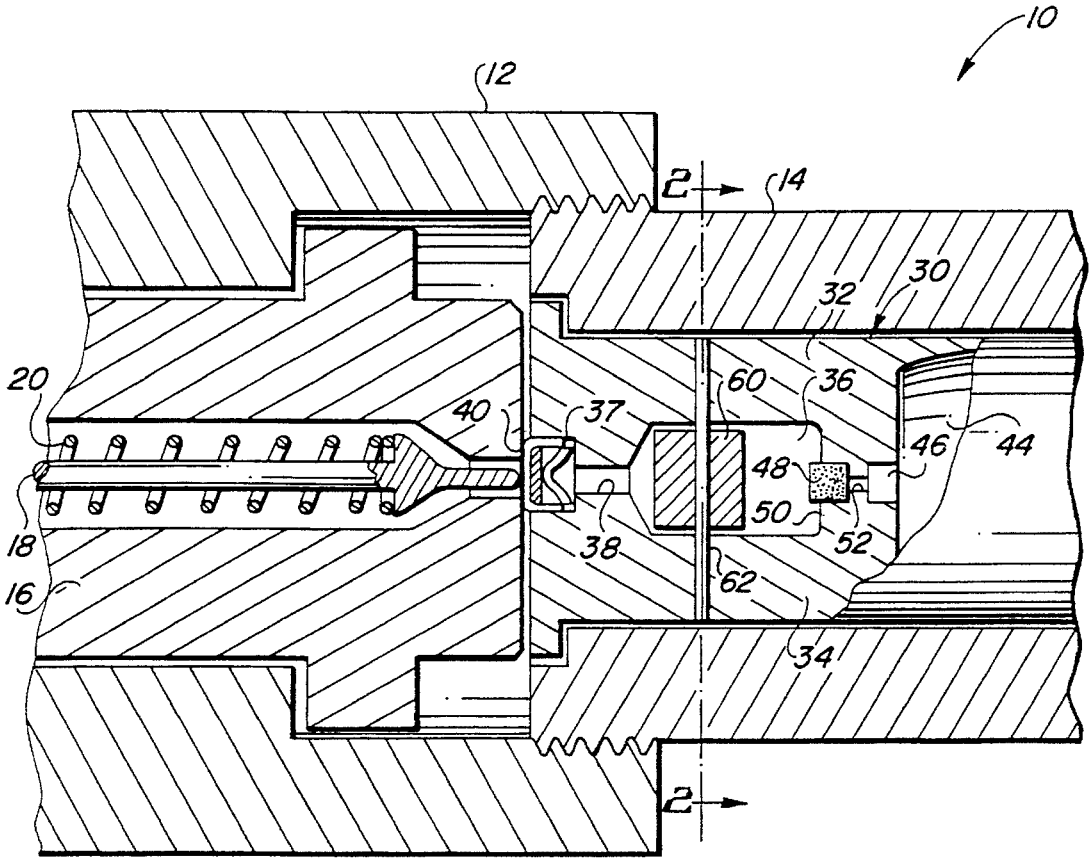
FIG. 1 is a schematic sectional side view, partially broken away, of a portion of a gun utilizing one particular arrangement in accordance with the present invention.
Figure 2:
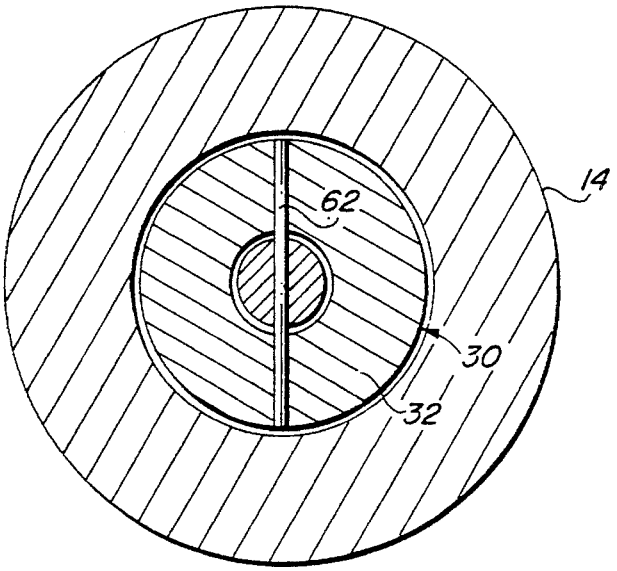
FIG. 2 is a schematic sectional view taken along the line 2—2 in FIG. 1, looking in the direction of the arrows.

FIGS. 1 and 2 of the drawing schematically represent portions of a gun 10 having a receiver 12 and attached barrel 14 in which a first embodiment of the invention is installed. A bolt 16 carrying a firing pin 18 biased in the forward direction by a spring 20 is shown within the receiver 12.

A cartridge 30 is installed within the barrel 14. The cartridge 30 has a cartridge case 32 including a base portion 34 shaped to define an expansion chamber 36 communicating with a primer recess via a primer vent 38. A percussion primer 40 is mounted within the primer recess 37 in a position of alignment with the firing pin 18. The explosive of the cartridge 30 is within an explosive chamber 44 to the right of the base 34 in FIG. 1. An electric detonator 46 is positioned adjacent the explosive chamber 44. A piezoelectric crystal 48 is mounted in the forward wall 50 of the expansion chamber 36 and connected to the electric detonator 46 via wires 52.

Near the rearward end of the expansion chamber 36, as depicted in FIG. 1, is an inertial element in the form of a flyer plate 60 which is held in place by a shear pin or shear wire 62. The flyer plate 60 may be a disk or plate, preferably circular, or, as shown in FIGS. 1 and 2, a cylindrical plug.

Figure 3:
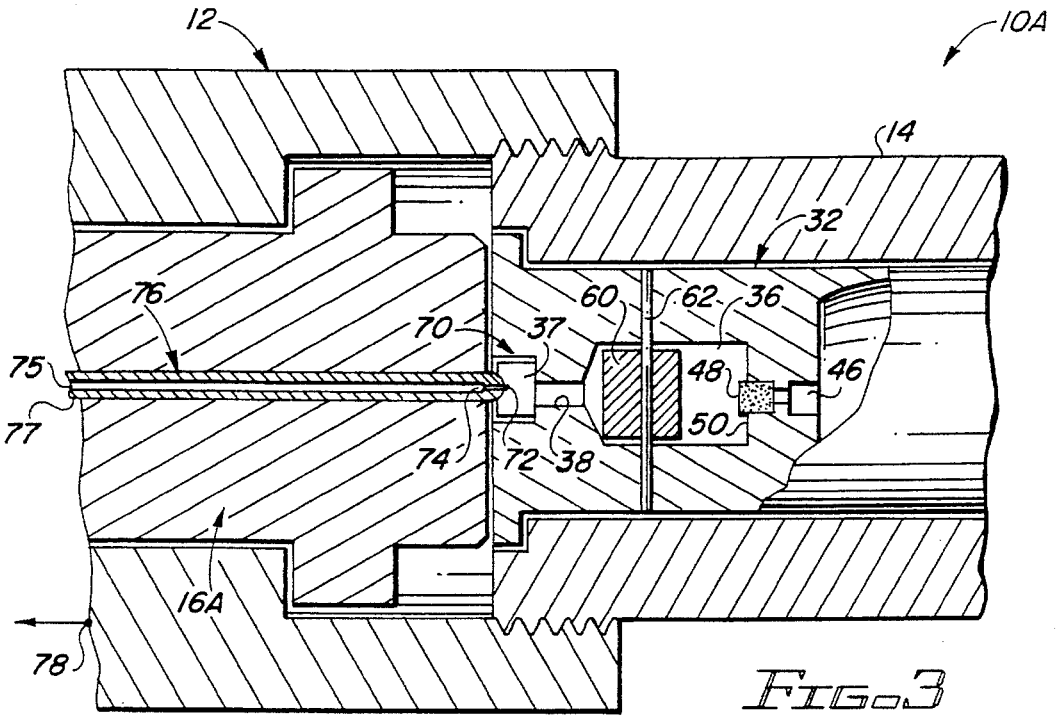
FIG. 3 is a schematic view like FIG. 1, but showing an alternative initiating arrangement.

A variant of the arrangement of FIG. 1 is depicted schematically in FIG. 3, wherein like elements are designated by like reference numerals. FIG. 3 shows a gun 10A having an electric primer 70 in place of the percussion primer 40 of FIG. 1. The electric primer 70 has an electric primer contact 72 which is contacted by electrical contact 74 in the bolt 16A. An electrical wire 76 consisting of insulation 77 sheathing a central conductor 75 extends from the contact 74, and a ground connection 78 is provided to complete the electrical firing circuit which extends to a source of electrical energy (not shown). In other respects, the structure of FIG. 3 is identical to that of FIG. 1.

When the primer, either the percussion primer 40 of FIG. 1 or the electric primer 70 of FIG. 3, is detonated, the explosive force from the expanding gas is transmitted through the primer vent 38 to energize the flyer plate 60. The shear pin 62 is severed as the flyer plate 60 is driven forward to impact the piezoelectric crystal 48. In these arrangements, the impact with the piezoelectric crystal 48 is at an energy level which causes the piezoelectric crystal 48 to generate an electrical pulse sufficient to initiate the electric detonator 46, thereby initiatng the explosive or other material to be detonated in the explosion chamber 44 and firing the gun.

The energy transmitted by the flyer plate 60 is derived from the chemical energy stored in the percussion primer 40 or the electric primer 70. When the primer is fired by the impact of a firing pin for the percussion primer 40 or by electrical energy for the electric primer 70, the primer charge, typically containing a small amount of a sensitive explosive material, such as lead styphnate and other materials, explodes, producing flame, gas, hot fragments and some sort of shockwave which are passed through the primer vent 38 into the expansion chamber 36. The amount of flame, hot fragments, gas pressure and shockwaves transmitted depends on the amount of priming material, its reaction to the initiation energy and the diameter, length and geometry of the primer vent 38. In most cases, the primary energy transmitting mechanism is the hot gases which are produced. Once these gases expand into the rear of the expansion chamber 36, the chamber pressurizes against the base of the flyer plate 60 until the load is sufficient to rupture or shear the retaining wire, shear disk or other retention system which is used.

The expansion volume and the effective cross-sectional area of the pressurized flyer plate 60 determine the theoretical load placed upon the shear mechanism. This may be modified by other factors, such as cooling of the gas produced by the primer, variations in primer output due to expected manufacturing variations, variations in output due to material temperature, blowby past the flyer plate 60, and variations in failure loads of the particular retaining device. As the flyer plate 60 is driven forward, air trapped between its forward face and the forward end of the expansion chamber is compressed and acts like a spring, tending to slow the movement of the flyer plate. The degree of compression is also affected by gas temperature and blowby. Shockwaves through the expanding gas and the solid components may also modify the flyer plate action, as will the time required for pressure to build up and for retaining devices to shear, and the mass and inertia of the flyer plate 60. The kinetic energy remaining in the flyer plate must be sufficient to create the impact energy required for the desired piezoelectric crystal output with sufficient margin to insure reliable function. At the same time, it must not cause physical failure of the cartridge body or the gas seal between the primer and the primer pocket, even under marginal conditions. Assembly of a percussion primer by press-fitting it into a conventional primer pocket, with conventional primer venting, and solidly supporting the cartridge in a firing chamber, such as in a gun barrel with breechblock designed to support the cartridge base and primer base as is done with conventional small arms and obturating cased artillery, has been used for years to provide gas pressure seals at pressures in excess of 75000 psi (pounds per square inch) as a common practice.

In these arrangements of the invention, the flyer plate 60 serves to control and/or concentrate the shock against the piezoelectric crystal 48. The energy transmitted by the flyer plate 60 is a function of the explosive energy of the primer 40 or 70, the control of impulse, time and pressure transmitted through the primer vent 38 to the expansion chamber 36, and the load required to release the retained flyer plate 60. This rupture force is predetermined in accordance with the properties of the selected retaining mechanism and the relationship of the desired terminal velocity of the flyer plate 60 to the pressure build up from the exploding primer, as discussed hereinabove. In the arrangements shown in FIGS. 1–3, this involves the shearing of the shear pin 62. Other arrangements may be used for retaining the flyer plate 60: for example, in place of the shear pin 62, it may be retained by a creep spring or a detent, a shear disk, a shearable or compressible ring, adhesive or some other mechanism. The dimensions, geometry and mass of the flyer plate 60 also act to control flyer plate impact energy.

Figure 4:
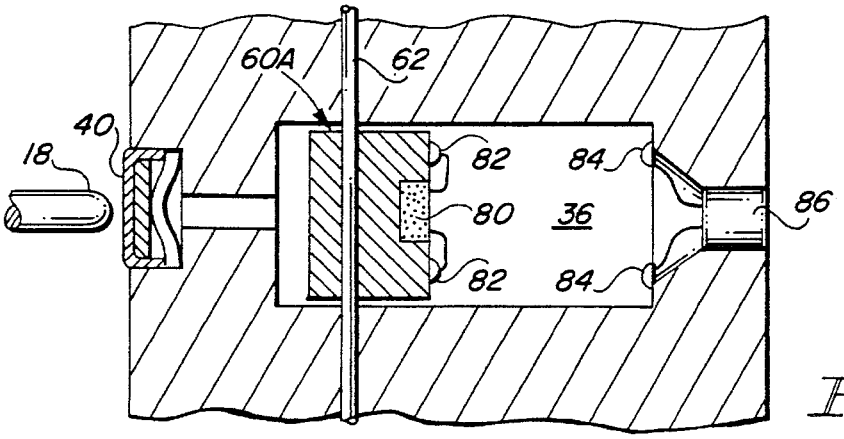
FIG. 4 is a schematic view like FIG. 1, but showing a different configuration of portions of the electrical firing circuit of FIG. 1.
Figure 5:
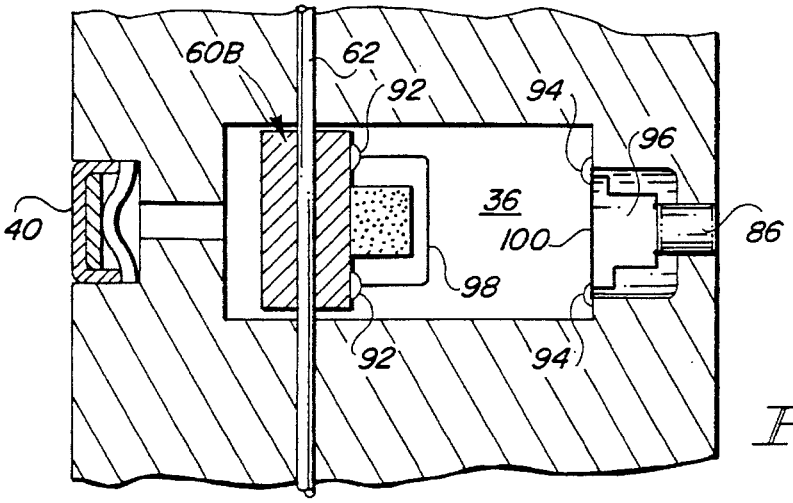
FIG. 5 is a schematic view showing an alternative arrangement to that of FIG. 4.

FIGS. 4 and 5 schematically depict alternative embodiments of the present invention which incorporate specific safety circuitry for the electric detonator 86 to minimize or preclude the possibility of the electric detonator being fired inadvertently, as by stray electric fields, inadvertent output from the piezoelectric crystal and the like.

FIG. 4 is a schematic diagram of the central portion of the gun 10 of FIG. 1 incorporating a percussion primer 40 and associated firing pin 18. It will be understood, however, that the electric primer 70 and electrical firing circuitry of FIG. 3 may readily be substituted. A flyer plate 60A is shown retained in position within the expansion chamber 36 by a shear pin 62. The flyer plate 60A has a piezoelectric crystal 80 mounted on the forward face of the flyer plate 60A and recessed therein with connections leading to a first pair of contacts 82. At the forward end of the expansion chamber 36, mounted in positions of alignment with the contacts 82, is a second pair of electrical contacts 84 which are electrically connected to the electric detonator 86. It will be observed that, in this arrangement, the piezoelectric crystal 80 is not in electrical circuit with the detonator 86 until the primer 40 is fired, thereby severing the shear pin 62 and driving the flyer plate 60A with its piezoelectric crystal 80 to the forward end of the expansion chamber 36. This enables the contacts 82 to meet the contacts 84 and thereby complete the circuit from the piezoelectric crystal 80 to the electric detonator 86 to explode the detonator as the impact shocks the piezoelectric crystal and generates the firing pulse.

The alternative embodiment depicted in FIG. 5 is somewhat similar to the embodiment depicted in FIG. 4 except that the piezoelectric crystal 90, instead of being recessed within the forward face of the flyer plate as in FIG. 4, is mounted on the forward face of the flyer plate 60B to project therefrom. A recess 96 is provided in the forward wall of the expansion chamber 36, shaped to receive the piezoelectric crystal 90 when the flyer plate 60B is driven forward to impact the piezoelectric crystal 90 and cause it to generate an electrical pulse. A first pair of contacts 92, connected to the piezoelectric crystal 90, are mounted on the forward face of the flyer plate 60B and a corresponding second pair of electrical contacts 94 which are connected to the electric detonator 86 are located on the forward wall of the expansion chamber 36 in a position to complete the electrical circuit with the contacts 92 when the flyer plate 60B moves to the forward position.

Each pair of contacts 92, 94, has a corresponding shear wire 98, 100, respectively, electrically connected across it and physically located in a position to be ruptured by the forward travel of the piezoelectric crystal 90 into the recess 96. In the arrangement of FIG. 5, the first and second pairs of electrical contacts 92, 94 are not only physically separated as shown in FIG. 4, thereby preventing any electric output from the piezoelectric crystal 90 from reaching the electric detonator 86, but are shorted by the shear wires 98, 100 so as to prevent any stray fields from initiating the electric detonator 86. The severing of the shear wires 98, 100 by the propulsion of the flyer plate 60B and piezoelectric crystal 90 to the forward end of the expansion chamber 36 serves to remove the short circuits across the respective pairs of contacts 92, 94 concurrently with the junctures of the corresponding contacts to complete the piezoelectric-electric detonator circuit and impact the piezoelectric crystal 90, thereby closing the electrical circuit from the piezoelectric crystal 90 to the electric detonator 86 at the instant the piezoelectric crystal pulse is generated to fire the gun. Where initiation of the detonator, 46 or 86, leads to the creation of a high overpressure which penetrates into the expansion chamber 36, the flyer plate 60 should be driven rearward to block the primer vent 38 and protect it from high pressure gas blowback.

Figure 6:
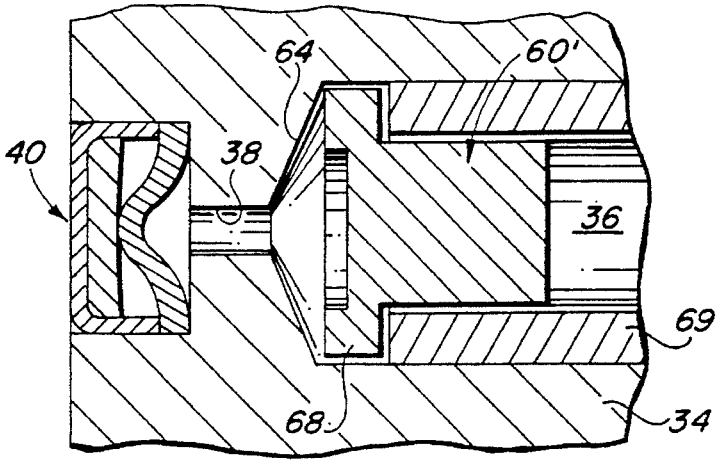
FIG. 6 is a schematic view of a variant of the arrangement of FIG. 1.

FIG. 6 is a schematic view of a portion of the arrangement depicted in FIG. 1, showing a modification of the flyer plate therein. Like elements are designated in FIG. 6 by like reference numerals.

Thus, the body of a cartridge case 34 is shown having a percussion primer 40, a primer vent 38 and expansion chamber 36. As in FIG. 1, there is a countersunk portion 64 transitioning between the primer vent 38 and the expansion chamber 36. The flyer plate 60' is like the flyer plate 60 of FIG. 1, except that it is integrally formed with a shear disk portion 68 which extends radially outward from the body of the flyer plate 60' at the rear thereof. The central bore of the cartridge case 34 is enlarged diametrically and a circumferential sleeve 69 is positioned therein to bear against the radially outward extension of the shear disk portion 68.

Prior to detonation of the primer 40 in the configuration of FIG. 6, the flyer plate 60' is held in the position shown at the rear of the expansion chamber 36 by the retainer sleeve 69. Even after the primer 40 is initiated and begins to build up pressure behind the flyer plate 60' by sending gas and other explosive particles through the primer vent 38, the flyer plate 60' is retained in position until a force due to the pressure behind it reaches a predetermined threshold level sufficient to rupture the shear disk portion 68, severing it from the flyer plate 60'. From that time on, the performance of the flyer plate 60' is the same as that of the flyer plate 60 of FIG. 1 when the shear wire 62 is sheared off.

Figure 7:
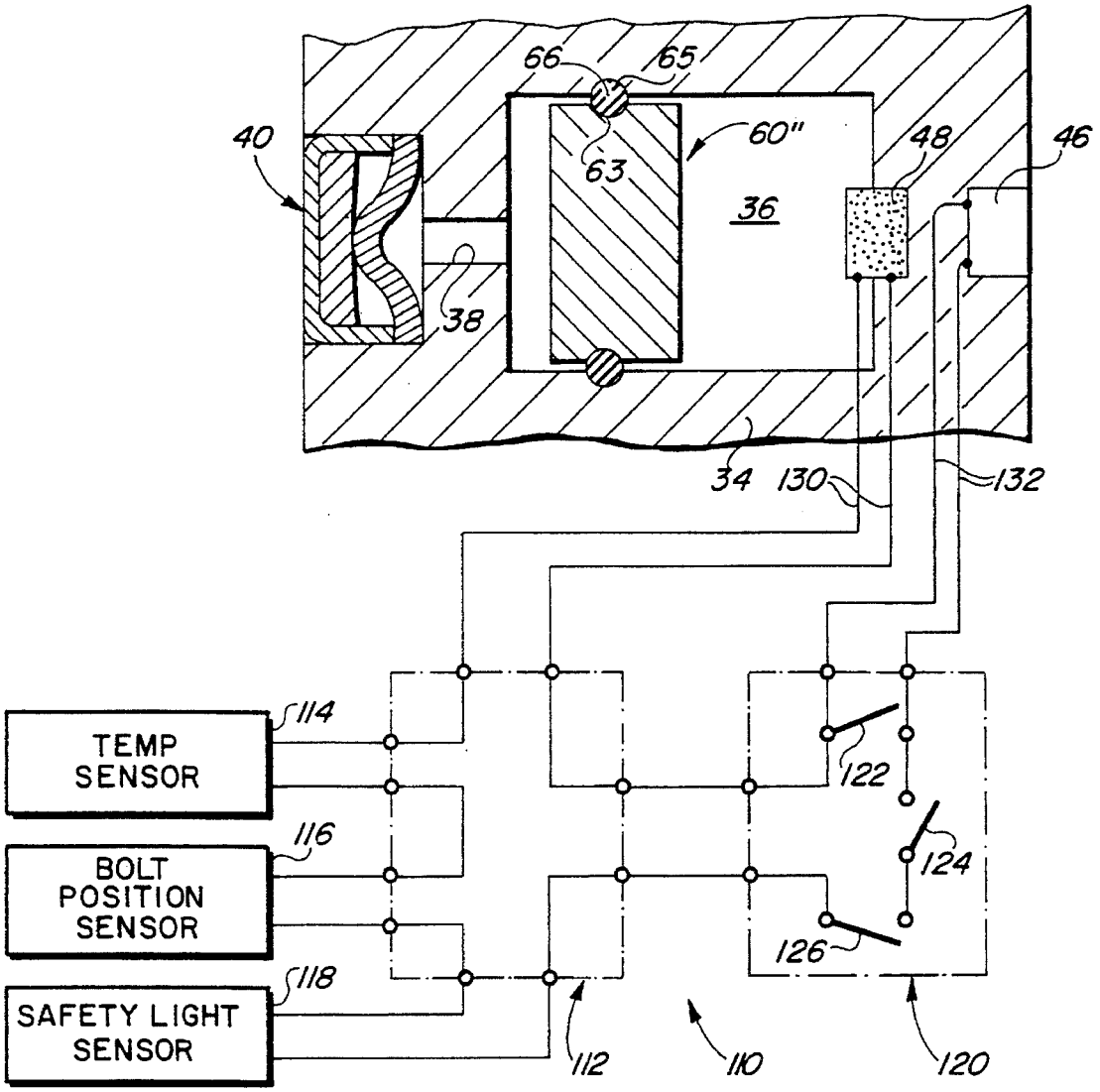
FIG. 7 is a schematic block diagram showing details of associated electronic circuitry for controlling the electrical firing circuit.

The schematic arrangement of FIG. 7 shows an upper portion corresponding to the embodiment of FIG. 1 with associated control circuitry 110 shown in the lower portion of FIG. 7. The upper portion shows a minor modification of the structural configuration of FIG. 1 in that a shear ring 66 is substituted for the shear pin 62 of FIG. 1 and the flyer plate 60" and bore of the cartridge base 34 are provided with corresponding circumferential recesses 63 and 65, respectively, for receiving and retaining the shear ring 66 in position. The shear ring 65 may have the configuration of a small O-ring but is constructed of materials having the desired shearability and failure strength or compressibility.

The function of the shear ring 66 is the same as that of the shear pin 62 of FIG. 1 or the shear disk 68 of FIG. 6; it retains the flyer plate 60" in a rearward position until a force due to the pressure which builds up behind the flyer plate 60" from initiation of the primer 40 reaches a predetermined threshold level which is sufficient to rupture or disengage the shear ring 65, thereby enabling the flyer plate 60" to be driven forward to impact the piezoelectric crystal 48.

The control circuitry 110 in the lower half of FIG. 7 is connected in series between the piezoelectric crystal 48 and the electric detonator 46 so as to control the application of any electrical output from the piezoelectric crystal 48 to the electric detonator 46 and also to prevent stray charges or electromagnetic fields from affecting the detonator 46. The circuitry 110 is shown comprising a terminal block 112 connected in a series path with a switch block 120 via wires 130, 132 which extend to the electric terminals of the piezoelectric crystal 48 and the electric detonator 46, respectively. A plurality of sensor elements 114, 116 and 118 are shown connected in series circuit via circuit paths within the terminal block 112. Various types of sensors and/or control elements may be used for the blocks 114, 116, 118.

For example, in one particular arrangement in accordance with the invention, the sensor 114 is a temperature limit sensor, the sensor element 116 is a sensor (such as a microswitch or a photocell) for sensing when the bolt is closed, and the sensor element 118 serves to determine when the range safety lights are on. If desired, this may have a delay timer built into the sensor to close the circuit path therethrough.

Within the switch block 120 are switches 122, 124 and 126, also serving to control the circuit paths between the piezoelectric crystal 48 and the electric detonator 46. Switch 122 is a detonator shorting switch which is normally closed to protect electric detonator 46 from stray voltages. Switch 124 is a fire switch which is closed to permit energization of the electric detonator 46. Switch 126 is a safe/arm switch which must be closed to arm the firing circuit.

The specific elements recited hereinabove as comprising the control circuitry 110 are disclosed by way of example only. Other electronic, electrical or even electro-mechanical systems may be used in place of the elements of control circuitry 110 in order to ensure that certain self-contained or external conditions are met before the output of piezoelectric crystal 48 is allowed to be transmitted to the electric detonator 46. These conditions may include sensor response, logic circuits, time or human intervention. Some typical sensors may include one or more of the following: temperature, time or time delay, pressure, or function or safing of some other device such as an arming switch, a door opening, or function of some other system. Switch 122 of FIG. 7 permits the detonator circuit to be shorted until the circuit is armed. It would also be possible to extend or delay the moment of detonator function by use of an energy storage device, such as a condenser or a functioning thermal battery, or by switching to some other stored energy system including mechanical, pneumatic or hydraulic devices which are capable of delivering or releasing a firing pulse. For example, a solenoid could compress and cock a spring or arm the release mechanism of a previously compressed spring. Other equivalent mechanisms will occur to those skilled in the art, if needed or desirable.

The various preferred embodiments of the present invention as disclosed herein involve improved arrangements for the firing of an electrically detonated cartridge within a gun via a piezoelectric-crystal-generated pulse. The adequacy of the electrical pulse generated by the piezoelectric crystal is assured by the use of a primer which is exploded by the firing mechanism of the gun to drive a flyer plate from a retained rest position to the forward end of an expansion chamber where the piezoelectric crystal is impacted. The controlled application of the explosive force from the primer to the flyer plate results in a controlled acceleration and velocity of the flyer plate at impact of the piezoelectrical crystal so that the desired electrical pulse is present for application to the electric detonator. In particular embodiments of the present invention, certain safety arrangements are disclosed which are designed to protect the firing circuit from stray fields and preclude or minimize the likelihood of firing of the electric detonator until the intended ignition pulse from the piezoelectric crystal is generated.

Although there have been described hereinabove various specific arrangements of a combination explosive primer and electro-explosive device in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A combined explosive primer and electro-explosive device comprising:

a firearm cartridge having an explosion chamber adjacent a base portion and an electric detonator positioned to detonate a quantity of explosive material to be detonated in said chamber;

a piezoelectric crystal mounted within an expansion chamber in said base portion in a position to be impacted by the movement of an inertial element which is also mounted within said expansion chamber, said inertial element having a forward end facing the detonator and a rear end remote therefrom, the forward end terminating in a forward wall;

electric circuit leads for electrically coupling the piezoelectric crystal to the electric detonator; and means including an explosive primer for driving said inertial element to a point of impact of the piezoelectric crystal in order to fire said cartridge.

2. The device of claim 1 further including means for releasably retaining said inertial element in a fixed position within said expansion chamber remote from the detonator, said inertial element being movable through said expansion chamber in a direction toward the detonator upon release from said retaining means.

3. The device of claim 2 wherein said inertial element comprises a flyer plate having a configuration and cross section selected to match the shape and dimensions of said expansion chamber and a length which is less than the length of the expansion chamber in order to permit axial movement of the flyer plate within the expansion chamber.

4. The device of claim 3 wherein said expansion chamber is generally cylindrical in cross section with a tubular sidewall terminating in a forward end wall adjacent the detonator, and said flyer plate comprises a generally cylindrical plug.

5. The device of claim 1 wherein said explosive primer is mounted within said base portion in a primer recess permitting access to the primer by initiating means and further including a primer vent extending from said primer recess to said expansion chamber at the end of said inertial element which is remote from the detonator.

6. The device of claim 5 wherein the primer is a percussion primer which is explodable upon impact by a firing pin.

7. The device of claim 5 wherein the primer is an electric primer which is explodable upon the application of a firing pulse from an associated trigger circuit.

8. The device of claim 1 wherein said piezoelectric crystal is recessed within a forward wall of the expansion chamber in a position to be impacted by said movable inertial element at the end of its travel along the expansion chamber.

9. The device of claim 1 further including momentary contact means for completing the circuit from the piezoelectric crystal to the electric detonator concurrently with the impacting of the piezoelectric crystal to generate the firing pulse for the electric detonator.

10. The device of claim 9 wherein said piezoelectric crystal is mounted at the forward end of the movable inertial element and said momentary contact means comprise a first pair of contacts positioned on the forward wall of the movable inertial element and electrically connected to the piezoelectric crystal and a second pair of electrical contacts mounted on a forward end wall of the expansion chamber and connected to the electric detonator, said second pair of electrical contacts being aligned with corresponding contacts of said first pair in order to complete an electrical circuit between the piezoelectric crystal and the electric detonator upon movement of the movable inertial element to the forward end wall of the expansion chamber.

11. The device of claim 10 wherein the piezoelectric crystal is recessed within the forward wall of the movable inertial element in a position to be impacted upon the inertial element reaching the forward end wall of the expansion chamber concurrently with the completion of the electrical circuit between the piezoelectric crystal and the electric detonator by said first pair of contacts meeting said second pair of contacts.

12. The device of claim 10 further including means for shorting across at least one pair of said first and second pairs of contacts, said shorting means being severable upon the movement of the piezoelectric crystal and movable inertial element to the position for energizing the electric detonator.

13. The device of claim 12 wherein said shorting means comprise a wire extending from one contact of said first pair to the other and between the piezoelectric crystal and a point of impact at the forward end wall of the expansion chamber.

14. The device of claim 12 wherein said shorting means comprise a wire extending from one contact of said second pair to the other and between the piezoelectric crystal and a point of impact at the forward end wall of the expansion chamber.

15. The device of claim 12 wherein said piezoelectric crystal is mounted so as to protrude from the forward wall of the movable inertial element, wherein the forward end wall of the expansion chamber is shaped to define a recess for receiving the piezoelectric crystal and impacting it upon entry therein, and wherein said shorting means are positioned to be severed by the entry of the piezoelectric crystal into said recess.

16. The device of claim 1 further including control circuitry coupled in series to said electric circuit leads between the piezoelectric crystal and the electric detonator.

17. The device of claim 16 wherein said control circuitry includes a plurality of elements for selectively controlling circuit paths between the piezoelectric crystal and the electric detonator.

18. The device of claim 17 wherein said plurality of elements includes a shorting switch for bypassing stray field voltages from the electric detonator.

19. The device of claim 17 wherein said plurality of elements includes a switch for selectively completing a circuit path from the piezoelectric crystal to the electric detonator.

20. The device of claim 17 wherein said plurality of elements includes a plurality of sensors for monitoring selected parameters related to the initiation of the electric detonator and enabling the circuit path between the piezoelectric crystal and the electric detonator upon detection of said parameters within a predetermined acceptable range.

21. The device of claim 20 wherein said plurality of sensors includes a temperature limit sensor, a sensor for detecting closure of the weapon in which the cartridge is positioned for firing and a third sensor for monitoring illumination from range safety lights.

22. The device of claim 2 wherein said retaining means comprise a rupturable member coupled to the inertial element and having the capability of resisting rupture until a force in excess of a predetermined threshold level is applied to said inertial element in a direction urging movement of the inertial element toward the electric detonator.

23. The device of claim 22 wherein said rupturable member is a shear pin positioned to retain the inertial element adjacent one end of the expansion chamber remote from the detonator.

24. The device of claim 22 wherein said rupturable member is a shear ring surrounding the inertial element and positioned in opposed circumferential recesses in the inertial element and a tubular side wall of the expansion chamber, respectively.

25. The device of claim 22 wherein said rupturable member is a shear disk integrally formed with the inertial element.

26. The device of claim 25 wherein said shear disk projects radially outward from the end of the inertial member remote from the electric detonator and wherein the retainer means further comprise a circumferential sleeve mounted within the expansion chamber to hold the inertial element in a rearward position until the shear disk is ruptured.

* * * * *